US009668553B2

(12) United States Patent
Haythornthwaite et al.

(10) Patent No.: US 9,668,553 B2
(45) Date of Patent: Jun. 6, 2017

(54) UMBRELLA HAVING AN ANTI-INVERSION MECHANISM

(71) Applicant: Shedrain Corporation, Portland, OR (US)

(72) Inventors: David Haythornthwaite, Fujian Province (CN); Andrew Haythornthwaite, Fujian Province (CN)

(73) Assignee: SHEDRAIN CORPORATION, Portland, OR (US)

( * ) Notice: Subject to any disclaimer, the term of this patent is extended or adjusted under 35 U.S.C. 154(b) by 0 days.

(21) Appl. No.: 14/614,906

(22) Filed: Feb. 5, 2015

(65) Prior Publication Data

US 2016/0227893 A1 Aug. 11, 2016

(51) Int. Cl.

| | |
|---|---|
| ***A45B 25/22*** | (2006.01) |
| ***A45B 25/18*** | (2006.01) |
| ***A45B 25/02*** | (2006.01) |
| *A45B 25/08* | (2006.01) |

(52) U.S. Cl.

CPC ..... *A45B 25/22* (2013.01); *A45B 25/02* (2013.01); *A45B 25/18* (2013.01); *A45B 25/08* (2013.01)

(58) Field of Classification Search

CPC ..... A45B 25/02; A45B 25/08; A45B 25/18; A45B 25/22

USPC ..... 135/27, 32, 33.5, 38–40, 42, 43

See application file for complete search history.

(56) References Cited

U.S. PATENT DOCUMENTS

| | | | | | |
|---|---|---|---|---|---|
| 864,572 | A | * | 8/1907 | Stimmel | A45B 25/14 135/20.3 |
| 1,167,431 | A | * | 1/1916 | Raabe | A45B 25/22 135/27 |
| 1,369,996 | A | | 3/1921 | Westbeld | |
| 1,434,942 | A | | 11/1922 | Brandt | |
| 2,185,587 | A | * | 1/1940 | Carlisle | A45B 25/02 135/33.5 |
| 2,522,645 | A | | 9/1950 | Senna | |
| 2,528,002 | A | * | 10/1950 | Katzberg | A45B 25/08 135/39 |
| 2,528,003 | A | * | 10/1950 | Katzberg | A45B 25/08 135/39 |
| 3,424,180 | A | * | 1/1969 | Andolfi | A45B 25/02 135/28 |
| 3,856,032 | A | * | 12/1974 | Schafer | A45B 25/06 135/28 |

(Continued)

FOREIGN PATENT DOCUMENTS

| | | | | |
|---|---|---|---|---|
| CN | 2381177 | | 6/2000 | |
| DE | 390403 C | * | 2/1924 | A45B 25/22 |

(Continued)

*Primary Examiner* — Noah Chandler Hawk

(74) *Attorney, Agent, or Firm* — Leason Ellis LLP

(57) ABSTRACT

An umbrella has a plurality of ribs attached to a runner by main struts. The umbrella has an anti-inversion mechanism formed of a plurality of anti-inversion struts. Each anti-inversion strut is pivotally coupled to one respective main strut and is pivotally connected to a floating joint member that is freely movable along a length of one respective rib. The anti-inversion mechanism also includes a stop that is fixedly attached to the rib and restricts the degree of travel of the floating joint member along the rib and is positioned to prevent the respective rib from inverting in response to an applied force.

18 Claims, 16 Drawing Sheets

(56) References Cited

U.S. PATENT DOCUMENTS

| | | | | |
|---|---|---|---|---|
| 4,259,974 | A * | 4/1981 | de Polo | A45B 19/00 135/24 |
| 5,593,239 | A | 1/1997 | Sallee | |
| 5,732,725 | A | 3/1998 | Ko | |
| 6,167,894 | B1 | 1/2001 | Lin | |
| 6,216,712 | B1 | 4/2001 | Lin | |
| 6,276,380 | B1 | 8/2001 | Okuda | |
| 6,328,047 | B1 * | 12/2001 | Lee | A45B 17/00 135/15.1 |
| 6,330,887 | B1 | 12/2001 | Chen | |
| 6,715,504 | B2 | 4/2004 | Chen | |
| 6,758,229 | B2 * | 7/2004 | Wang | A45B 25/08 135/39 |
| 7,913,709 | B2 * | 3/2011 | Brebner | A45B 19/06 135/31 |
| 7,980,262 | B1 * | 7/2011 | You | A45B 25/02 135/32 |
| 8,136,541 | B2 * | 3/2012 | Beaulieu | A45B 25/02 135/28 |
| 8,607,808 | B1 * | 12/2013 | You | A45B 25/22 135/25.33 |
| 8,991,412 | B2 * | 3/2015 | Holland | E04H 15/28 135/31 |
| 2002/0078986 | A1 | 6/2002 | Tsun | |
| 2002/0129843 | A1 * | 9/2002 | Wang | A45B 25/02 135/29 |
| 2003/0178050 | A1 | 9/2003 | Wu | |
| 2005/0051202 | A1 | 3/2005 | You | |
| 2006/0283490 | A1 | 12/2006 | Gobel | |
| 2007/0056615 | A1 * | 3/2007 | Lai | A45B 19/08 135/25.4 |
| 2007/0272288 | A1 | 11/2007 | Brebner | |
| 2011/0108074 | A1 * | 5/2011 | You | A45B 25/22 135/20.1 |
| 2012/0180835 | A1 * | 7/2012 | Frost | A45B 25/18 135/44 |
| 2014/0000666 | A1 * | 1/2014 | You | A45B 25/22 135/29 |

FOREIGN PATENT DOCUMENTS

| | | | | |
|---|---|---|---|---|
| DE | 817791 | | 10/1951 | |
| TW | GB 2413489 | A * | 11/2005 | A45B 25/08 |
| WO | WO 2016/040994 | | 3/2016 | |

* cited by examiner

UMBRELLA HAVING AN ANTI-INVERSION MECHANISM

TECHNICAL FIELD

The present invention relates to umbrellas and more particularly, relates to an umbrella that is designed to resist inversion in adverse conditions including strong winds, etc.

BACKGROUND

As is well known, an umbrella is a device that protects the user from the elements and in particular from liquid and frozen precipitation or even the sun, etc. A traditional umbrella has the following parts: a pole, a canopy, ribs, a runner, springs and a ferrule. A pole is the metal or wooden shaft that runs between the umbrella's handle at the bottom (or the base stand in the case of a patio model) and the canopy at the top. The canopy is the fabric part of the umbrella that catches the rain, the wind and the sun. The ribs are what give an umbrella its structure and shape. Outer ribs hold up the canopy and inner ribs (sometimes called stretchers) act as supports and connect the outer ribs to the umbrella pole. A runner slides up and down the pole while connected to the ribs/stretchers, and is responsible for the opening and closing of the canopy. Many umbrella designs include a top spring to hold the runner up when the canopy is open, a bottom spring to hold the runner down when the canopy is closed, and sometimes a center ball spring to extend the pole length in telescopic models. Strictly ornamental, the finial (also called the ferrule) is found on the very top of the umbrella, above the canopy.

Umbrella ribs function in a folding construction supporting the umbrella canopy fabric. Under normal operating conditions, the forces acting on the umbrella canopy fabric increase toward peak values when the canopy becomes fully deployed and when wind gusts tend to overturn the canopy. These forces are transmitted from the canopy to the canopy ribs, and can act on the ribs in opposite directions depending on the direction of the wind. The ribs thus have to be strong enough to withstand forces which can act on them from anyone of the two main opposite directions.

The above construction is the most common one for an umbrella and the canopy assumes a downward convex shape. One significant problem with such design arises when there is a strong wind or sudden gust which exerts a force against the inner surface of the canopy causing the canopy to invert from its normal position to an upward position to an upward convex position.

Umbrellas addressing the problems of wind gusts have been proposed with one solution being the placement of apertures located within the canopy which allow for the air to flow through the canopy reducing the total force experienced by the canopy. However, the apertures are not large enough to provide a sufficient airflow to greatly reduce the force and in most circumstances, the canopy still inverts. Another solution to this has been to add strings that connect from the umbrella strut to the tip area. However, this solution also suffers from a deficiency in that these strings can become loose over time or get cut or tangle, etc., during use.

It is therefore the object of the present invention to provide a windproof umbrella that acts so as to prevent the inversion of the umbrella in strong wind.

SUMMARY

According to one exemplary embodiment of the present invention, an umbrella includes an elongated shaft having a first end and an opposite second end and a runner slidably disposed about the elongated shaft and movable along a length of the shaft. The umbrella has a plurality of ribs that are attached to the runner by a plurality of main struts that move between open and closed positions in which in the open position, the ribs are in an open, extended position and in the closed position, the ribs are in a closed, collapsed position.

In accordance with the present invention, the umbrella has an anti-inversion mechanism formed of a plurality of anti-inversion struts. Each anti-inversion strut is pivotally coupled to one respective main strut and is pivotally connected to a floating joint member that is freely movable along a length of the rib. The anti-inversion mechanism also includes a stop that is fixedly attached to the rib and restricts the degree of travel of the floating joint member along the rib and is positioned to prevent the respective rib from inverting in response to an applied force.

BRIEF DESCRIPTION OF THE DRAWING FIGURES

DETAILED DESCRIPTION OF CERTAIN EMBODIMENTS

As discussed herein, the present invention is directed to improvement with respect to a number of components of an umbrella including but not limited to a shaft construction and a rib assembly thereof. As discussed herein, the features of the present invention can be implemented with both a manual type umbrella and an automatic type umbrella. In addition, the other features can be implemented with other types of umbrellas. Accordingly, the following discussion and figures describe exemplary embodiments that implement the teachings of the present invention.

Figure 1:
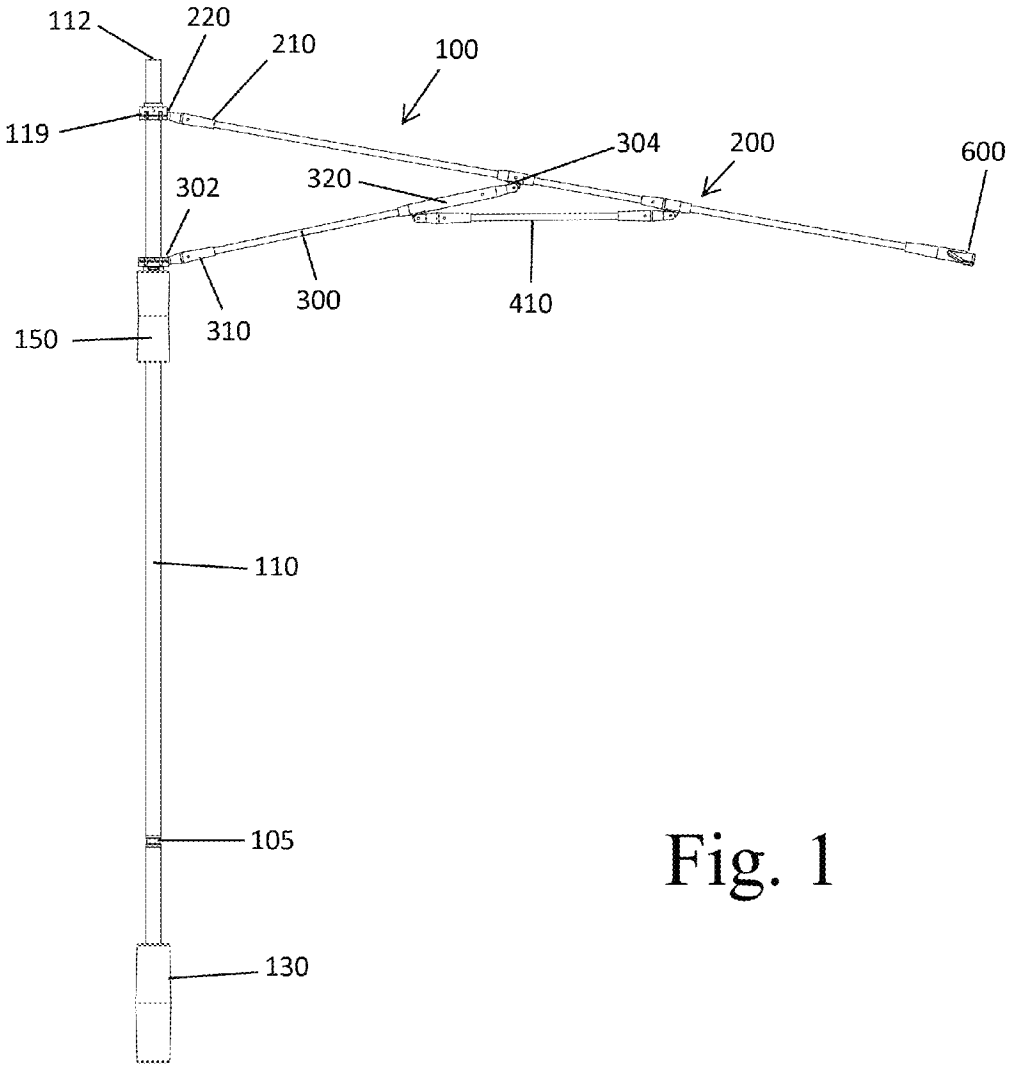
FIG. 1 is a side elevation view of an umbrella, of a manual type, including a shaft and an umbrella rib assembly in accordance with the present invention and being shown in a fully opened position, with only a single rib assembly being shown for sake of illustration purposes only.

FIG. 1 shows a side view of an umbrella 100 in accordance with one exemplary embodiment of the present invention with only one assembly being shown for sake of clarity and to simplify a discussion of the present invention. The umbrella 100 is of a type that is commonly referred to as a golf umbrella which is commonly known to be an oversized umbrella that is used to protect golfers and their carts from rain. The long shaft of a golf umbrella is usually not collapsible. It will be appreciated and understood that the various features of the present invention described herein can be implemented in other types of umbrellas besides golf umbrellas.

Figure 14:
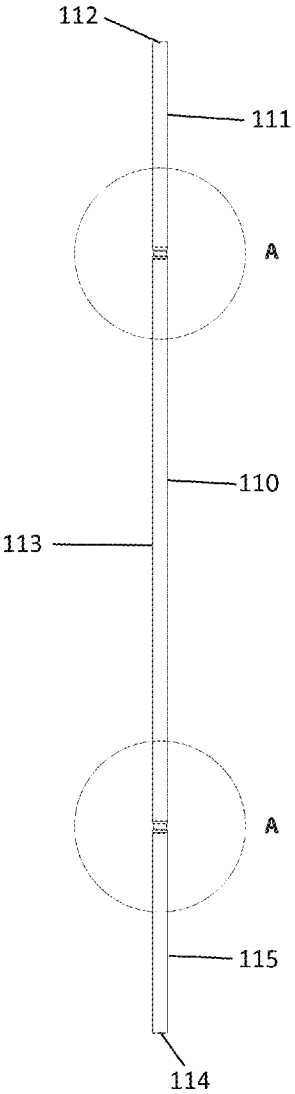
FIG. 14 is a side elevation view of a shaft assembly of the umbrella of FIG. 1.

As shown in FIGS. 1 and 14, the umbrella 100 includes a shaft 110 that has a first (top) end 112 and an opposite second (bottom) end 114. The shaft 110 itself can be formed of any number of different components to cooperate to provide shaft 110 and the shaft 110 illustrated in FIG. 1 is part of a manual umbrella assembly in which the user manually opens and closes the umbrella as described herein. At the first end 112, a cap or decorate ferrule (not shown) is typically provided to close off the shaft 110 and at the second end 114, a handle 130 is provided for grasping by the user.

Figure 16:
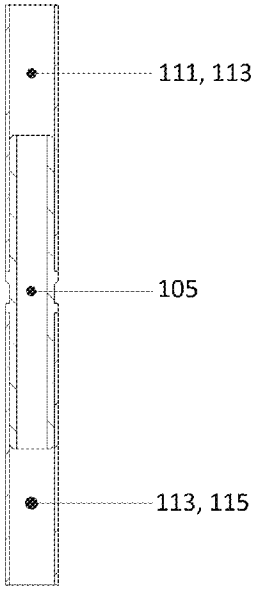
FIG. 16 is a cross-sectional view of the shaft lock.
Figure 15:
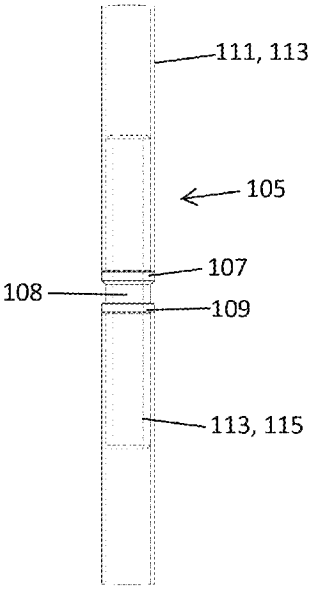
FIG. 15 is an enlarged side elevation view of a shaft lock that is part of the shaft assembly.

Referring to FIGS. 14-16, the illustrated shaft 110 is formed of a plurality of different shaft sections that mate together to form the assembled shaft. More specifically, the shaft 110 can be formed of three distinct shaft sections, namely, a first shaft section 111, a second shaft section 113, and a third shaft section 115. The first shaft section 111 is attached at one end to the cap/ferrule and at its other end to one end of the second shaft section 113. The second shaft section 113 is attached at its other end to one end of the third shaft section 115. The third shaft section 115 is attached at its other end to the handle 130. Thus, the first shaft section 111 represents the top shaft section; the second shaft section 113 represents the middle shaft section; and the third shaft section 115 represents the bottom shaft section. The dimensions of the individual shaft sections 111, 113, 115 can differ and in particular, at least one of the length and/or width (e.g., diameter) can be different. In the illustrated embodiment, the sections 111, 113, 115 have the same width but the middle section 113 has a greater length than the sections 111, 115 which are shown to have the same lengths. For example, the three shaft sections 111, 113, 115 can be 14 mm shaft sections made of carbon.

The shaft sections 111, 113, 115 are connected to one another by means of coupling members 105. One coupling member 105 is attached between two adjacent shaft sections 111, 113, 115. The coupling member 105 can be thought of as, being a shaft lock member (lock insert) and can be formed of a metal material, such as aluminum. The lock member 105 can be a hollow member (tube) that has a first annular ridge (lip) 107 formed along its outer surface and a second annular ridge (lip) 109 formed along its outer surface and spaced from the first annular ridge 107. A space 108 is formed between the ridges 107, 109. The annular ridges 107, 109 define stops for the respect shaft sections. More specifically, an outer diameter of the lock member 105 outside of the annular ridges 107, 109 is selected such that it can be inserted into the hollow interior of the respect shaft sections 111, 113, 115 so as to form a friction fit therebetween (a mechanical fit). Since the annular ridges 107, 109 have a greater diameter than the inner diameter of the shaft sections 111, 113, 115, the lock member 105 cannot be inserted into the respective shaft section. Instead, these annular ridges 107, 109 act as stops and prevent further insertion of the lock member 105 into the respective shaft section. When assembled, the surface of the lock member 105 between the two ridges 107, 109 is visible.

The lock members 105 thus provide rigid coupling members securely attaching the shaft sections 111, 113, 115 to form the complete assembled shaft.

As mentioned above, one of the main components of an umbrella is a runner 150. The runner 150 is the part of the umbrella that opens and closes the umbrella 100, with the runner 150 moving along the shaft 110. The runner 150 is thus a hollow member that surrounds the shaft 110 and is movable along the shaft 110 and can be locked into one or more different positions. FIGS. 17A, 17B, 18A and 18B show the runner 150 in greater detail. The runner 150 is formed of several parts or portions including a generally cylindrical shaped base portion 152 and a shaft runner lock 154. A top portion 153 of the runner 150 is configured to receive and securely attach to a plurality of struts, as discussed below, to effectuate movement of the ribs 200. The top portion 153 thus includes a plurality of slots 155 formed circumferentially thereabout for receiving the struts. The shaft runner lock 154 is located between the top portion 153 and the base portion 152.

Figure 17B:
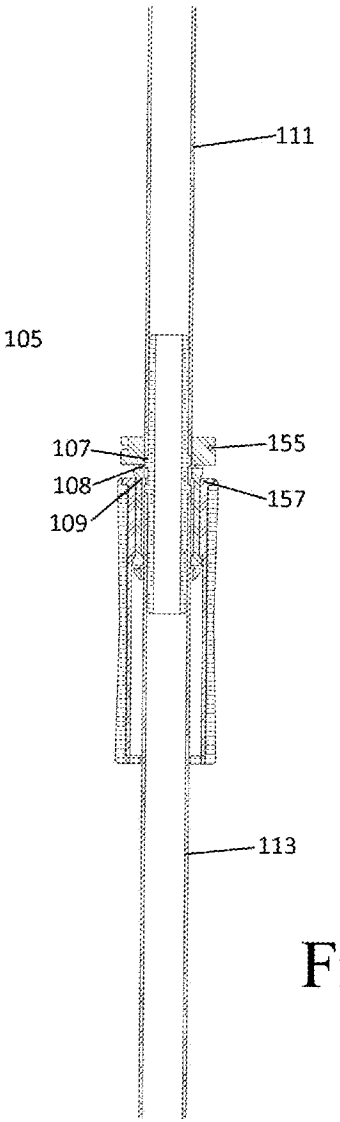
FIG. 17B is a cross-sectional view of the runner of FIG. 17A in the unlocked position.
Figure 17A:
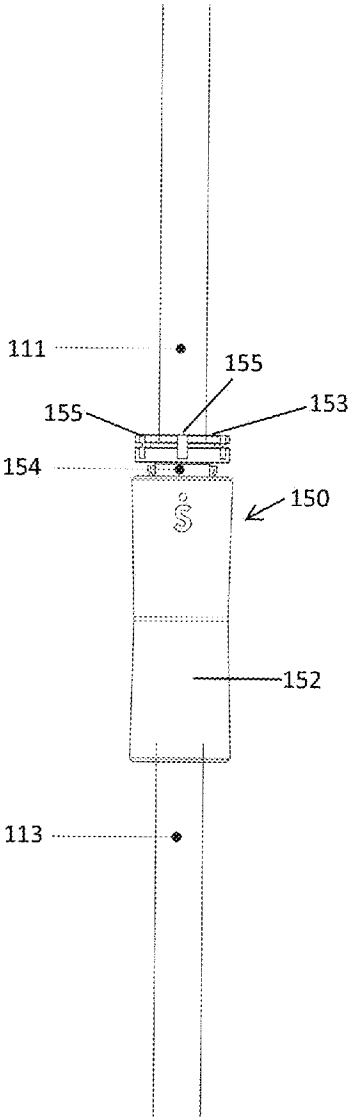
FIG. 17A is a side elevation view of a shaft assembly with the runner in an unlocked position.
Figure 18A:
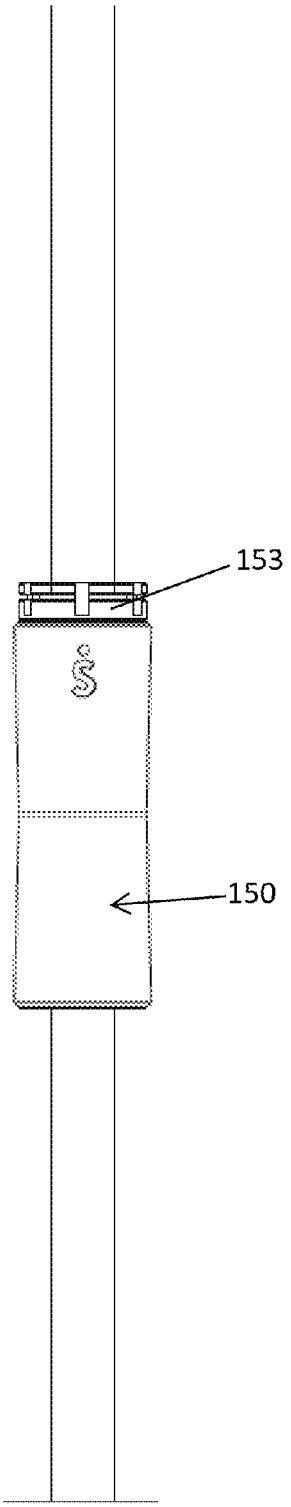
FIG. 18A is a side elevation view of the shaft assembly with the runner in a locked position.
Figure 18B:
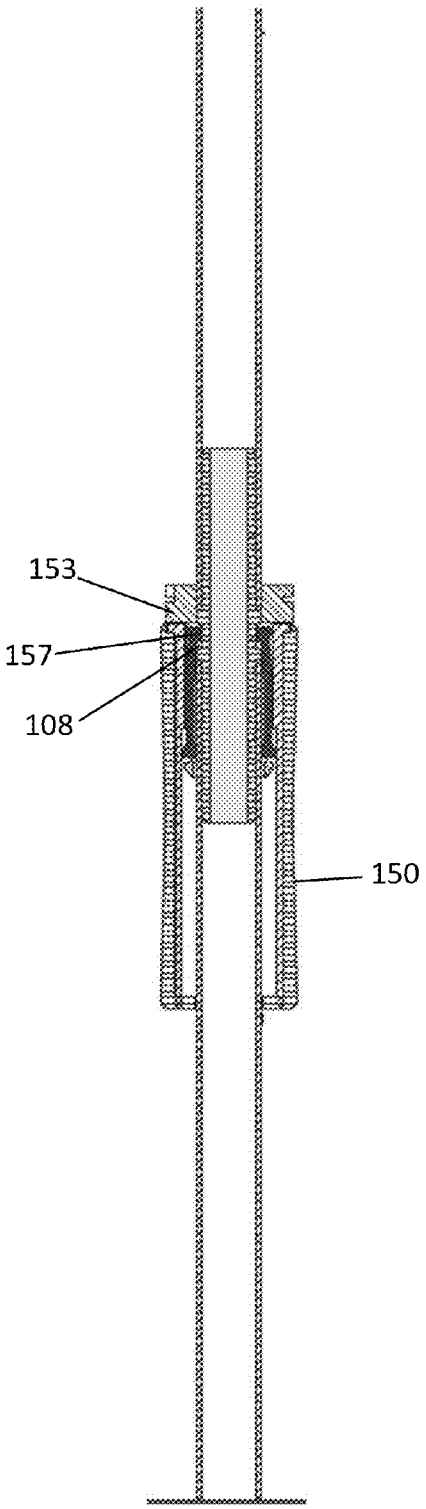
FIG. 18B is a cross-sectional view of the shaft assembly with the runner in the locked position.

The shaft runner lock 154 is designed to selectively lock the runner 150 into one of a plurality of locked positions along the shaft 110. FIGS. 18A and B are cross-sectional views of the runner 150. FIGS. 17A and 17B show the runner 150 in an unlocked (open) position relative to the lock member 105, while FIGS. 18A and 18B show the runner 150 in a locked position in which the runner 150 is locked in place relative to the shaft (i.e., is locked with respect to the lock member 105).

The lock member 105 can thus be in the form of a machined piece of aluminum (or other material) that provides a recess (space 108) for the runner 150 to make a connection to lock in place.

The shaft runner lock 154 is designed to lock and engage the shaft lock member 105. The shaft runner lock 154 is a push/pull runner that moves along the shaft. More specifically, the shaft runner lock 154 has a resilient lock member (runner catch) 157 that engages and seats within the space 108 formed between the annular ridges 107, 109. The resilient lock member 157 can comprise an annular shaped lock member 157 that has an inwardly directed lip that seats within the space 108 when it is in registration therewith. The resiliency (flexing) of the lock member 157 allows the lock member 157 to flex outward allowing disengagement with the space 108. When the lock member 157 (and in particular, the lip 159 thereof) is disengaged from the shaft lock member 105, the runner 150 can freely move along the shaft 110.

In use, when the runner 150 gets to a certain point where it cannot move vertically up anymore and then the pressure gets directed to the runner catch 157 which locks itself to the lock insert 105. One advantage of this design is that typically one would need to swage or reduce the diameter of the shaft in some way to allow the runner to engage the locking mechanism or one would have to add material to the outside of the shaft itself to make a locking position. However, adding material to the shaft is unsightly and also makes the folded diameter of the umbrella larger.

FIGS. 17A and 17B show the runner 150 in the unlocked position in which it is free to move along the shaft. In this unlocked position, the runner catch 157 is not actively engaged with the space (recess/channel) 108, while in FIGS. 18A and 18B, the runner catch 157 is actively engaged with the space (recess) 108, thereby locking the runner 150 to the shaft. As mentioned herein, when the runner 150 is pushed it gets to a certain point (such as the point shown in FIGS. 17A and 17B) where it cannot move any more in the vertical direction. Continued application of force against the runner in the vertical direction causes a force to be applied to the runner catch 157 and this results in deformation of the runner catch 157 in a radially inward direction toward the lock insert 105.

The runner catch 157 can be disengaged from the locking recess 108 by overcoming the retention force meaning that when the user exerts sufficient force to the runner 150, the runner catch 157 disengages from the locking recess 108 and the runner 150 is free to move.

As described herein, the lock members 105 are thus positioned along the shaft 110 to lock the runner 150 into desired positions, such as a fully open position and a fully closed position as illustrated herein.

It will be appreciated that the runner 150 is merely illustrative and not limiting of the scope of the present invention since other runner constructions can be used with the umbrella of the present invention.

To move the runner 150 along the shaft 110 in either direction (up and down), the user simply applies a sufficient force to cause the lock member 157 to disengage from the lock slot (space 108).

The umbrella 100 also includes a top notch 119 that is an annular shaped member that is attached to the shaft 110 and surrounds the shaft 110. The top notch 119 is configured to receive ribs 200 and thus serves an attachment point for such ribs. The ribs are attached to the shaft 110 by fitting into the top notch 119 and can then be held by a wire or other means. The top notch 119 can be a thin, round nylon or plastic piece with teeth around the edges.

As will be appreciated by the following description, each rib 200 is coupled to both the top notch 119 and the runner 150 and this results in the opening and closing of the rib 200 and the attached canopy (not shown) based on the direction of movement of the runner 150. The connection between the rib 200 and the runner 150 is made by a strut 300 (main strut). The strut 300 is an elongated structure that has a first end 302 and an opposite second end 304, with the first end 302 being pivotally attached to the runner 150 and the second end 304 being pivotally attached to the rib 200. The pivotal connection between the strut 300 and the runner 150 and between the strut 300 and the rib 200 can be accomplished with a fastener, such as a rivet or pin, etc. More specifically, a first strut joint 310 is formed between the strut 300 and the runner 150 at the first end 302 and a second strut joint 320 is formed between the strut 300 and the rib 200 at second end 304.

Figure 6:
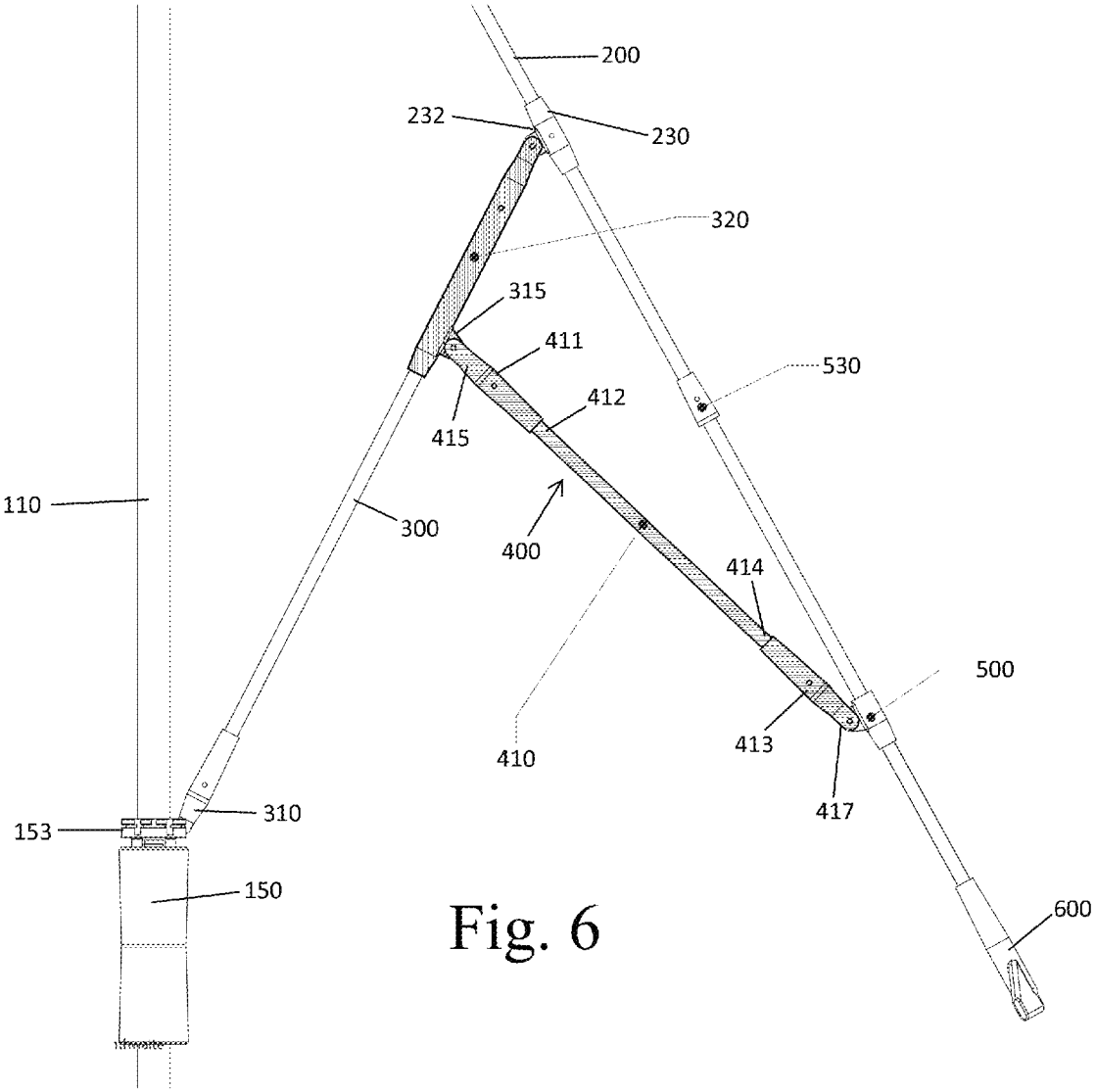
FIG. 6 is an enlarged cross-sectional view of a portion of the rib assembly of FIG. 1 showing the anti-inversion feature of the present invention.
Figure 7A:
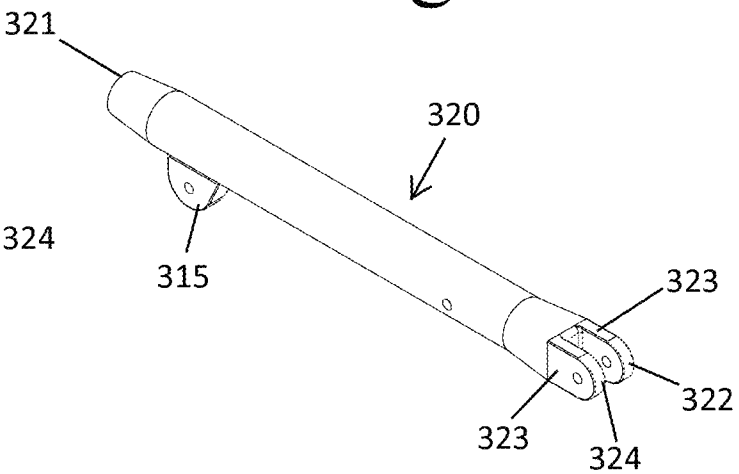
FIG. 7A is a perspective view of a strut to rib joint of the rib assembly of FIG. 1.
Figure 7D:
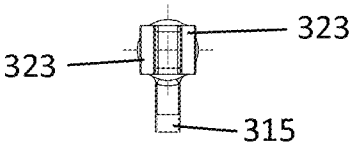
FIG. 7D is an end view of the strut to rib joint of FIG. 7A.
Figure 7C:
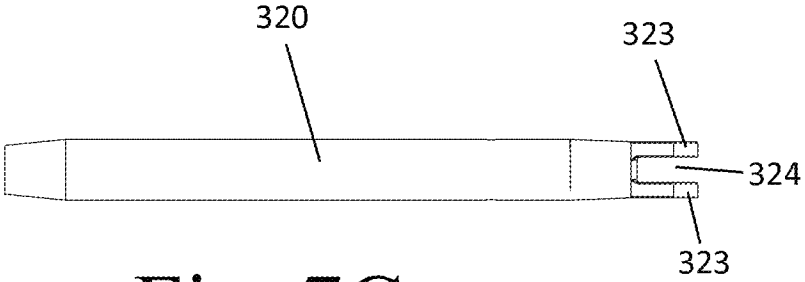
FIG. 7C is a top plan view of the strut to rib joint of FIG. 7A.
Figure 7B:
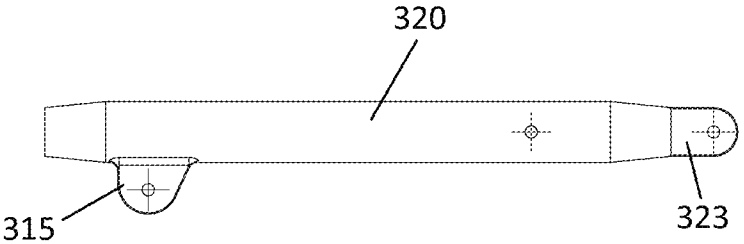
FIG. 7B is a side elevation view of the strut to rib joint of FIG. 7A.
Figure 8A:
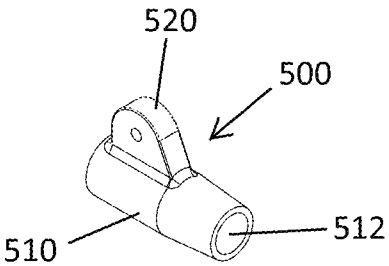
FIG. 8A is a perspective view of a floating joint of the rib assembly of FIG. 1.
Figure 8D:
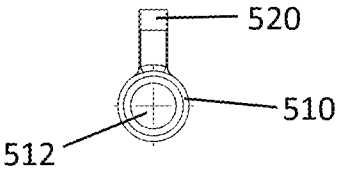
FIG. 8D is an end view of the floating joint of FIG. 8A.
Figure 8C:
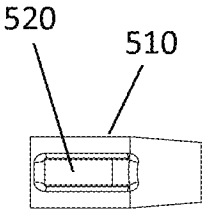
FIG. 8C is a top plan view of the floating joint of FIG. 8A.
Figure 8B:
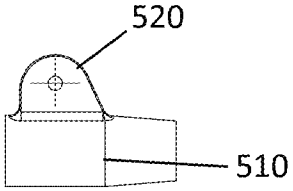
FIG. 8B is a side elevation view of the floating joint of FIG. 8A.
Figure 9A:
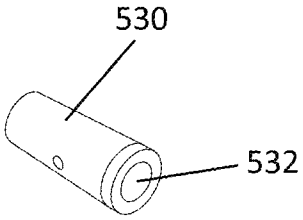
FIG. 9A is a perspective view of a floating joint stop of the rib assembly of FIG. 1.
Figure 9D:
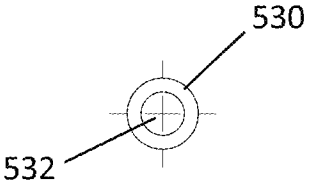
FIG. 9D is an end view of the floating joint stop of FIG. 9A.
Figure 9C:
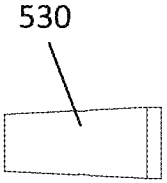
FIG. 9C is a top plan view of the floating joint stop of FIG. 9A.
Figure 9B:
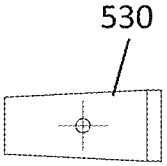
FIG. 9B is a side elevation view of the floating joint stop of FIG. 9A.

As shown in FIG. 6, the first strut joint 310 can be in the form of a male end joint that is configured to pivotally attach to the runner 150 to allow the strut 300 to pivot between an open position and a closed position.

The second strut joint 320 is in the form of a double joint and is best shown in FIGS. 6 and 7A-D. The second strut joint 320 can also be thought of as being a strut to rib joint and includes a first end 321 that attaches to the distal end of the strut 300 and a second end 322 which includes a pair of spaced fingers 323 that are parallel to one another and define an open space 324 therebetween and have aligned openings formed therein to allow passage of a fastener or the like to couple the joint to another structure (rib) as discussed below. As shown in FIGS. 7A-D, the second strut joint 320 also includes a joint connector 315 which can be in the form of a fin that protrudes outwardly from the body of the joint 310 (i.e., the connector 315 is formed perpendicular to the body of the connector 315). The joint connector 315 has an opening formed therein to allow a fastener to pass therethrough to allow to another structure to be pivotally attached to the joint connector 315.

The strut 300 can be formed of any number of different materials including a metal (e.g., a zinc alloy).

As shown in the figures, the rib 200 is an elongated structure that is coupled to other components of the umbrella to provide a rib assembly defined by a plurality of ribs 200 that open and close.

Each rib 200 is an elongated, flexible structure that has a first end (proximal end) 210 and an opposing second end (distal end) 212. The first end 210 is pivotally attached to the top notch 119 and more specifically, a first rib joint 220 can be provided at the first end 210 and be designed to allow the rib 200 to pivot relative to the top notch 119. In the illustrated embodiment, the first rib joint 220 can be in the form of a male end joint that can have a similar or the same construction as the first rib joint 310 that is part of the strut assembly.

As best shown in FIG. 6, the rib 200 also includes a second rib joint 230 that is disposed along the length of the rib 200. The second rib joint 230 can be fixedly attached to the rib 200 at a specific location thereof. The second rib joint 230 can thus be in the form of a hollow structure that receives the rib 200 and is fixedly attached to the rib 200 so that during use, the second rib joint 230 does not move but rather remains at the fixed location. The second rib joint 230 has a connector portion 232 in the form of a fin (protrusion)

that extends radially outward therefrom. The connector portion 232 can thus be formed perpendicular to the body of the second rib joint 230. The connector portion 232 includes an opening formed therethrough.

With reference to FIGS. 6 and 7A-D, the connector portion 232 is sized and configured to disposed within the open space 234 defined between the pair of spaced fingers 323 of the second strut joint 320. When inserted into the open space 234, the opening formed in the connector portion 232 axially aligns with the openings in the fingers 323 to allow passage of a fastener (such as a pin or rivet or wire, etc.), whereby the second strut joint 320 is pivotally attached to the rib 200 (and thus, the strut 300 is pivotally attached to the rib 200).

According to one aspect of the present invention, an anti-inversion mechanism (feature) 400 is provided and is configured to counter an inversion force that is applied to the umbrella during select operating conditions and in particular, during windy conditions or other adverse conditions. As is well known by users of umbrellas, if a sudden gust of wind is directed upwardly toward the inside of the umbrella, the pressure applied by the wind will invert the canopy causing the ribs to work counterproductively forcing it outwards. The canopy generally assumes a concave shape when inversion occurs and similarly, the ribs are force to pivot in unintended directions which can result in one or more ribs breaking. This renders the umbrella not usable. The umbrella of the present invention has the anti-inversion mechanism 400 that is made up of several components that are individually discussed below.

As shown in FIG. 6 and FIGS. 8A-C, the anti-inversion mechanism 400 comprises an anti-inversion strut 410 that has a first end 412 that is coupled to the strut 300 and an opposite second end 414 that is coupled to the rib 200. More specifically, the first end 412 is coupled to the second strut joint 320 and the second end 414 is coupled to the rib 200. The anti-inversion strut 410 has a first end joint 411 at the first end 412 and a second end joint 413 at the second end 414. The illustrated first and second end joints 411, 413 are in the form of female end joints and in particular, the first end joint 411 is defined by a pair of spaced apart fingers 415 that has an open space formed therebetween and the second end joint 413 is also defined by a pair of spaced apart fingers 417 that has an open space formed therebetween. The joint connector 315 (a male joint) is received into the open space between the fingers 415 (a female joint) of the first end joint 411, thereby coupling the anti-inversion strut 410 to the strut 300 in manner in which the anti-inversion strut 410 can pivot relative to the strut 300.

The first and second end joints 411, 413 can be mechanically fixed to the elongated strut body or the end joints 411, 413 can be molded over an existing strut material.

The anti-inversion strut 410 can be formed of any number of different materials including metals and synthetics. In one exemplary embodiment, the anti-inversion strut 410 comprises a 6 mm carbon Fiber rod.

The anti-inversion mechanism 400 also includes a floating joint 500 that is slidingly coupled to the rib 200 and configured to mate with the second end joint 413. FIGS. 8A-D illustrate the floating joint 500. The floating joint 500 has a main body 510 that includes a bore 512 that is formed therein and represents a through hole that passes from one end of the main body 510 to the other end thereof. The floating joint 500 also includes a joint connector 520 in the form of a fin that extends radially outward from the main body 510. The connector 520 can be formed perpendicular to the main body 510. The connector 520 has an opening formed therein. The connector 520 thus represents a male joint.

The anti-inversion strut 410 is coupled to the rib 200 by inserting the connector 510 between the spaced fingers 417 of the second end joint 413. As in the other joint, a fastener or the like can be used to couple the connector 510 to the fingers 417.

The rib 200 is received within and passes through the bore 512 and the size (diameter) of the bore 512 and the size (diameter) of the rib 200 are selected such that the floating joint 500 can freely move in a longitudinal direction along the length of the rib 200. This allows the floating joint 500 to be one which can freely travel up (toward the top notch 119) and down the rib 200 (toward the rib tip) when the umbrella opens and closes.

It will be appreciated that in another embodiment, the floating joint can be a male part that includes male connector 520; however, is positioned internal to the rib 200 such that the floating joint is free to move within the hollow inside of the rib 200 (e.g., an aluminum extrusion rib or formed steel rib). The rib 200 could thus have a linear slot formed therein through which the connector 520 passes. The operation of the floating joint is otherwise the same. In this alternative embodiment, the "floating action" of the floating joint thus occurs internally within the rib 200 as opposed to on the outside of the rib 200 in the illustrated embodiment.

With reference to FIGS. 6 and 9A-D, the anti-inversion mechanism 400 also includes a floating joint stop 530 that is fixedly attached to the rib 200. The floating joint stop 530 is disposed between the floating joint 500 and the second rib joint 230 and remains at a fixed location along the rib 200. The stop 530 includes a bore 532 that extends therethrough and receives the rib 200. The stop 530 is fixed to the rib 200 using traditional techniques so as to fix the stop 530 at a specific target location along the length of the rib 200. The stop 530 can be fixed by mechanical or overmolded which is the preferred method in this instance. The stop 530 is constructed such that it restricts the movement of the floating joint 500 in the direction toward the top notch 119.

It will be appreciated that when the umbrella is in the open position, the floating joint 500 rides along the rib 200 until it contacts the floating joint stop 530. The floating joint 500 in combination with the floating joint stop 530 prevents the rib 200 from inverting as when under the force of a strong wind. Inversion is prevented since the rib cannot bend upwardly due to the blocking action of the floating joint stop 530.

Figure 10B:
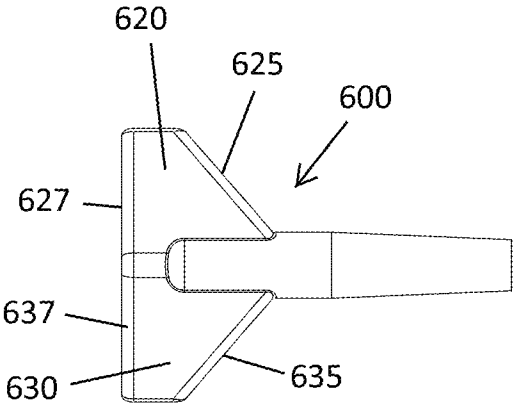
FIG. 10B is a top plan view of the rib tip.
Figure 10C:
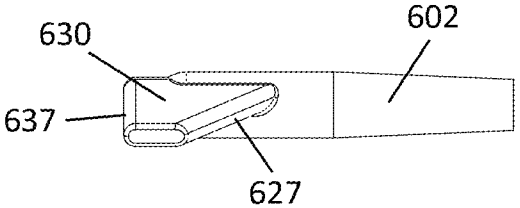
FIG. 10C is a side elevation view of the rib tip.
Figure 10A:
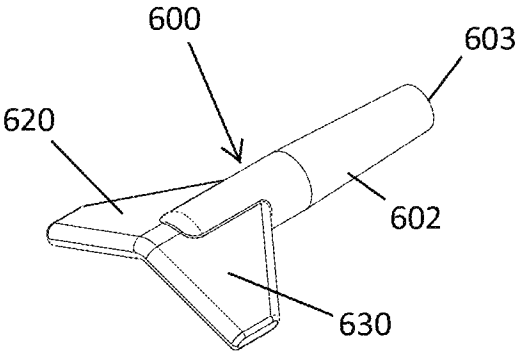
FIG. 10A is a perspective view of a rib tip.
Figure 10D:
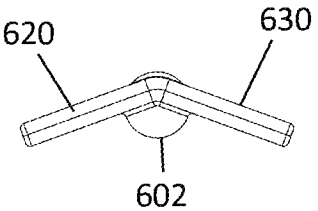
FIG. 10D is an end view of the rib tip.

FIGS. 10A-D and 11-13 illustrate the details of a tip 600 of the rib 200. The tip 600 comprises a structure which attaches to the distal end of the rib 200. The tip 600 is defined by a hollow main body 602 that has a bore 603 that receives the distal end of the rib 200 and is secured thereto. The tip 600 generally has a delta wing shape and is defined by first and second wing sections 620, 630 that extend outwardly and rearwardly from the main body 610. Each of the wing sections 620, 630 has an angled leading edge 625, 635, respectively, and an angled trailing edge 627, 637, respectively. In addition, as shown in FIG. 10D, the wing sections 620, 630 are angled relative to one another in that they do not lie entirely within the same plane. The tip 600 is constructed and designed such that it is angled to match the angle of the canopy when the canopy is in the open position.

Figure 11:
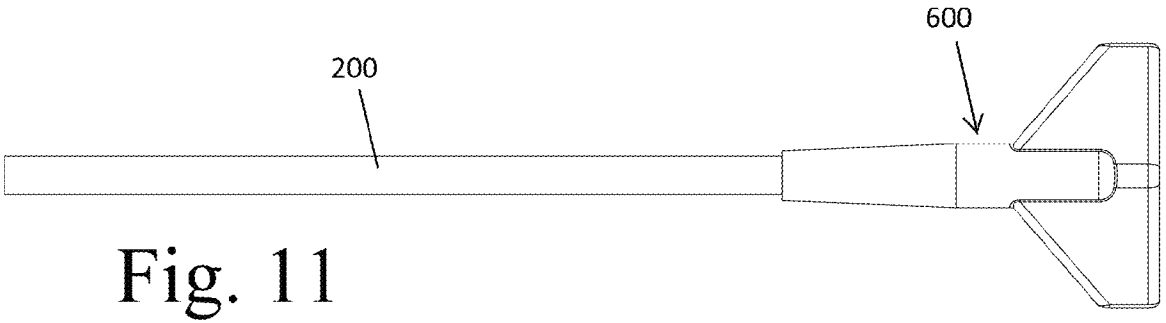
FIG. 11 is a top plan view of a rib tip assembly in accordance with the present invention.
Figure 12:
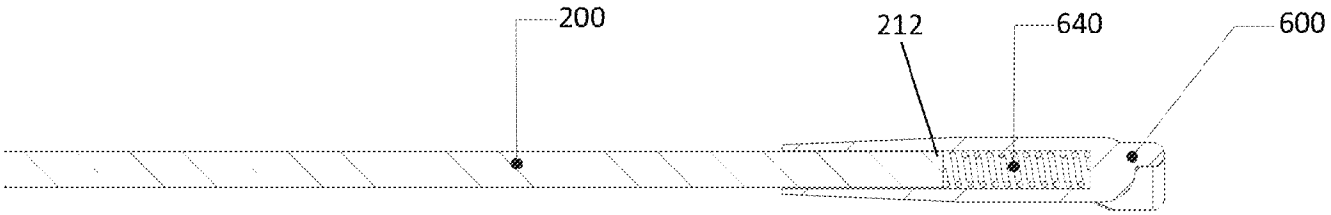
FIG. 12 is a cross-sectional view of the tip assembly in a closed/uncompressed state.
Figure 13:
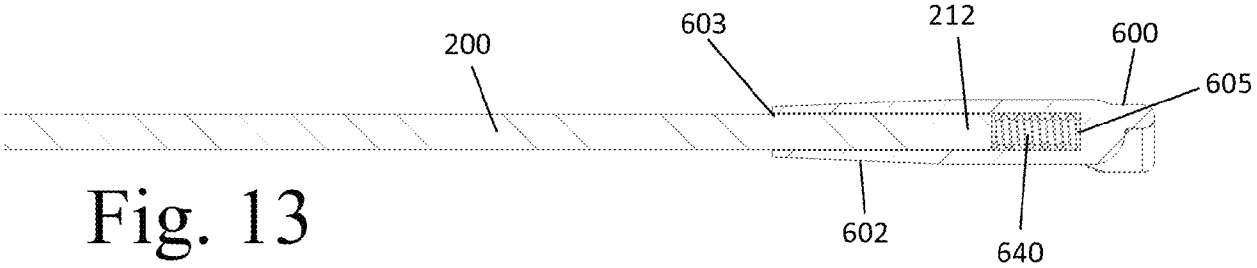
FIG. 13 is a cross-sectional view of the tip assembly in an open/compressed state.

FIGS. 11-13 illustrate yet another feature of the tip 600 in that the bore 603 of the main body 602 includes a biasing member 640, such as a spring. The spring 640 is disposed between the distal end of the rib 200 and a stop 605 formed in the main body 602. The stop 605 represents an end of the bore 603. The bore 603 is designed to permit movement of the distal end of the rib 200 so as to allow the ribs 200 and the umbrella for that matter to move between the open and closed positions. The spring 630 will thus store and release energy based on the manner in which the rib 200 acts thereon. FIG. 12 shows the tip assembly in a closed/uncompressed state, while FIG. 13 shows the tip assembly in an open/compressed state. In FIG. 13, the relationship between the canopy and the tip when the umbrella is opened due to the compressed state of the inner spring 640 of the tip.

In an alternative embodiment, the tip can comprise a male unit (structure) that has a protruding portion that is received within an opening (e.g., a bore) formed in the distal end of the rib (e.g., aluminum extrusion rib or formed steel rib). The coupling is thus formed by inserting the protruding portion of the tip into the opening (bore) of the rib. As in the above embodiment, a biasing member, such as a spring, can be disposed within the opening (bore) formed in the rib and in contact with the protruding portion of the tip that is likewise disposed within the opening (bore) of the rib.

Figure 2:
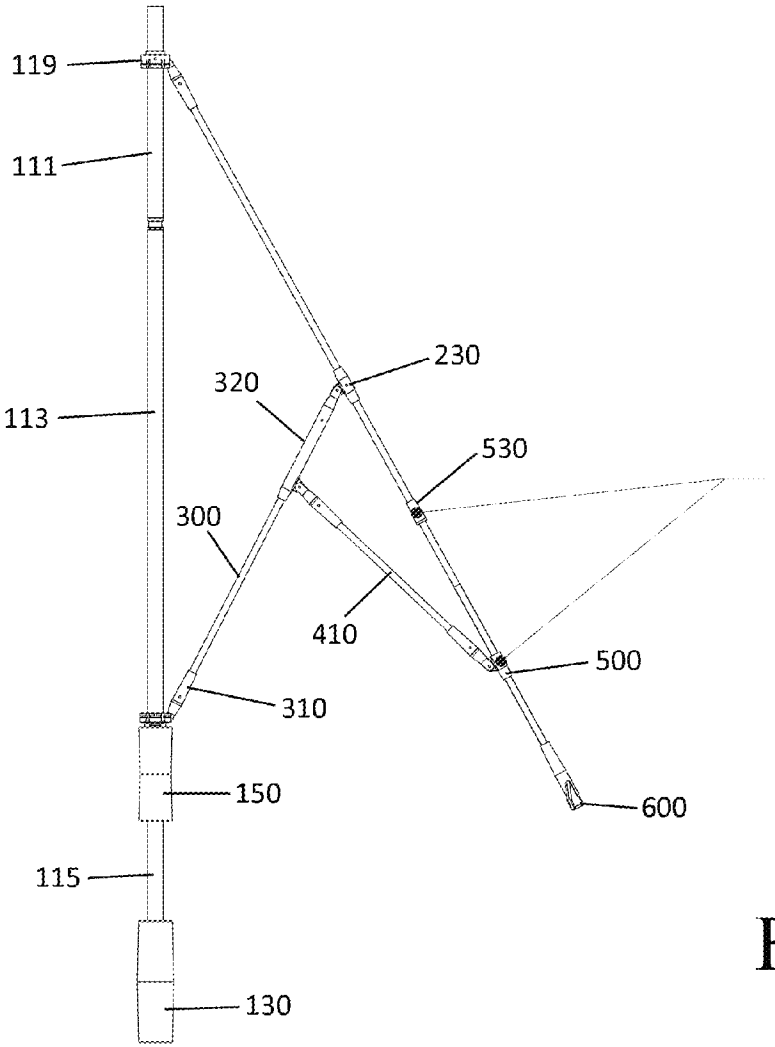
FIG. 2 is a side elevation view of the umbrella rib assembly of FIG. 1 shown in a half open position.
Figure 3:
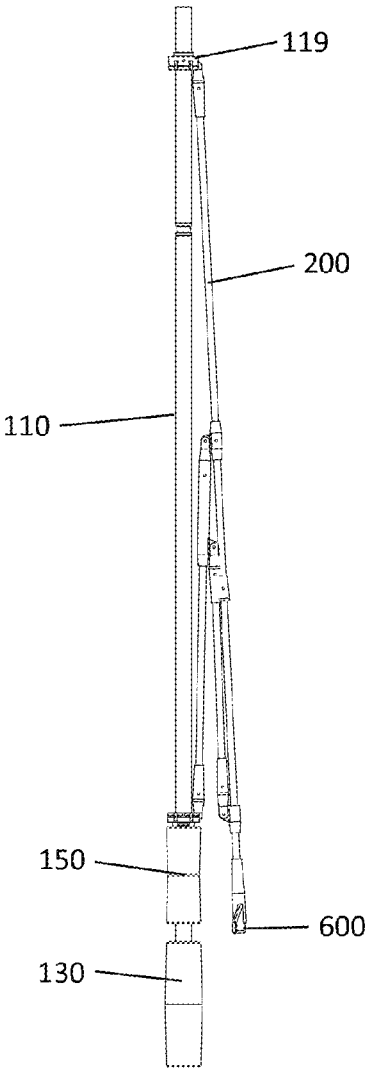
FIG. 3 is a side elevation view of the umbrella rib assembly of FIG. 1 shown in a closed position.
Figure 4:
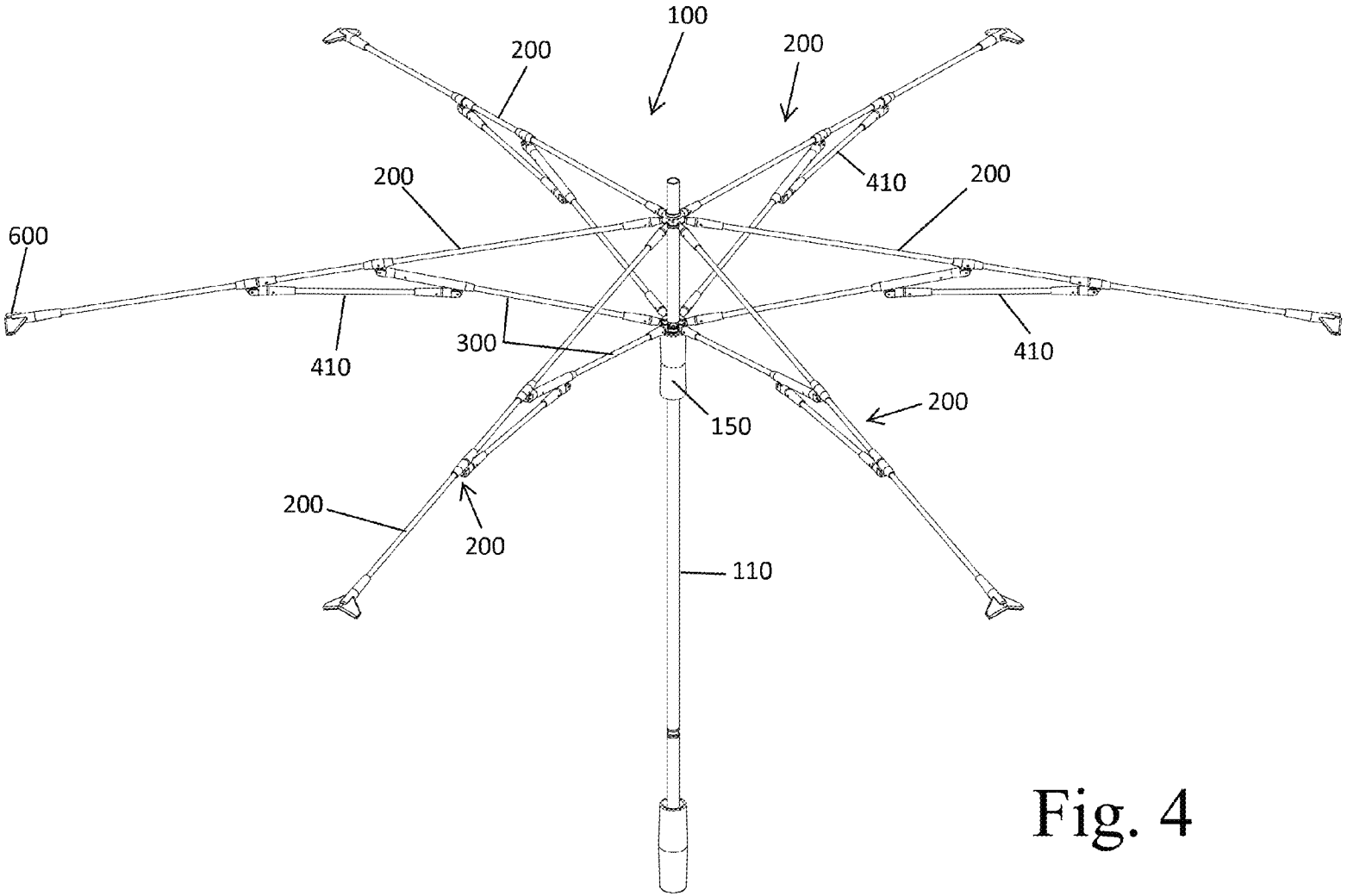
FIG. 4 is a perspective view of an umbrella having a plurality of rib assemblies of FIG. 1 being shown in a fully open position.

FIG. 2 shows the umbrella 100 and in particular, the single rib assembly in a half open position, while FIG. 4 shows the umbrella and in particular, the single rib assembly in a fully closed position.

Figure 5:
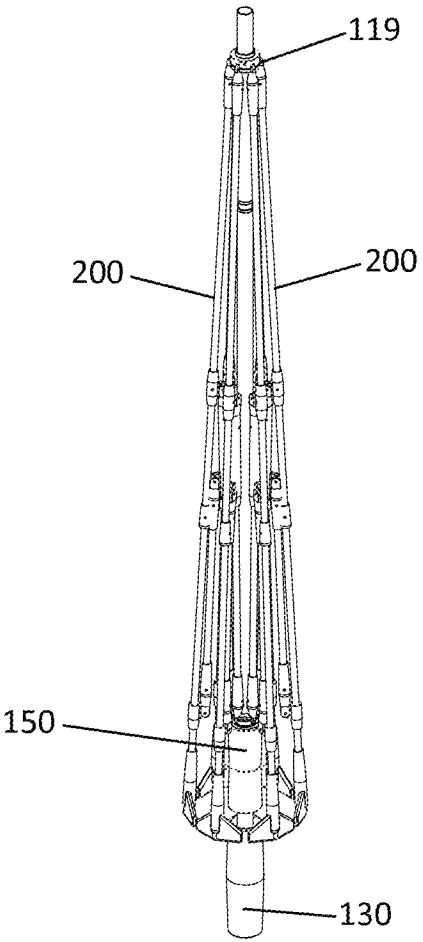
FIG. 5 is a perspective view of the umbrella of FIG. 4 being shown in a fully closed position.

FIG. 4 shows the umbrella 100 with the plurality of rib assemblies in the fully opened position, while FIG. 5 shows the umbrella 100 with the plurality of rib assemblies in the fully closed position.

While each part of the umbrella is necessary for its operation, the runner 150 is the part that opens and closes it. When the runner 150 is all the way down, the struts 300 are folded flat against the shaft and the umbrella is "closed," with the waterproof material and the ribs wrapped around the shaft. To open the umbrella, the user slides the runner 150 all the way to the top. The struts 300 extend, raising the ribs 200 to which they are attached and spreading the material tight (canopy) over the ribs 200.

Figure 19:
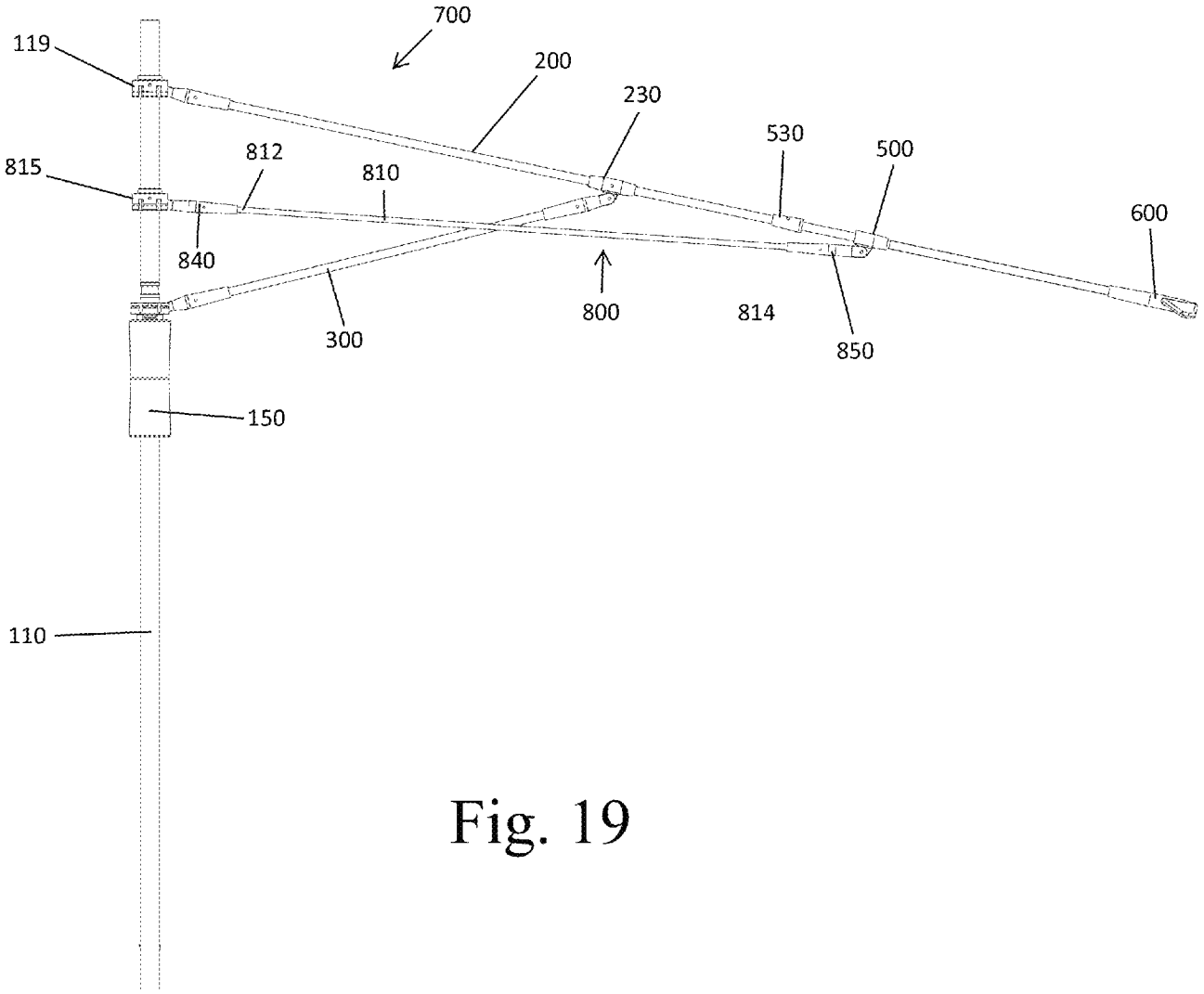
FIG. 19 is a side elevation view of an umbrella, of a manual type, including a shaft and an umbrella rib assembly in accordance with another embodiment of the present invention and being shown in a fully opened position, with only a single rib assembly being shown for sake of illustration purposes only.
Figures 20, 21:
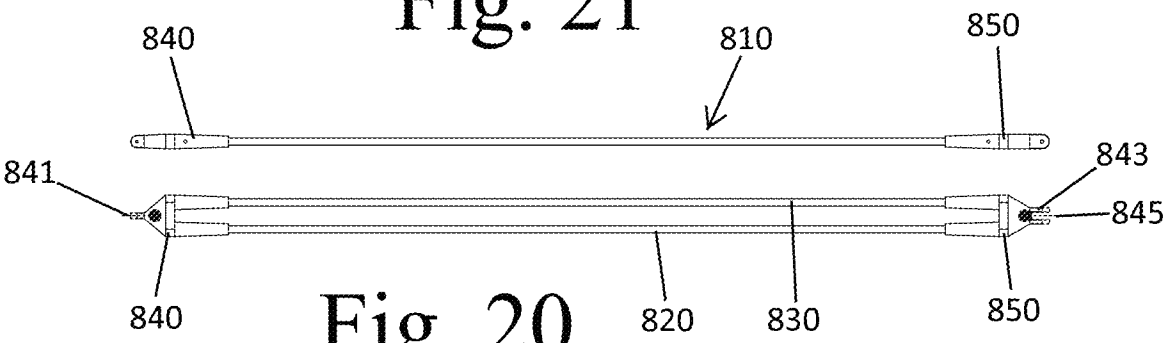
FIG. 20 is a top plan view of an anti-inversion strut according to one embodiment.
FIG. 21 is a side elevation view of the anti-inversion strut.

FIGS. 19-21 illustrate an umbrella 700 according to another embodiment. The umbrella 700 is similar to umbrella 100 and therefore, like elements are numbered alike. The umbrella 700 includes the shaft 110 and runner 150 which slidingly travels along the shaft 110. As in the previous embodiment, the connection between the rib 200 and the runner 150 is made by the strut 300. Unlike in the first embodiment, there is no anti-inversion strut 400 between the strut 300 and the rib 200. Instead, the umbrella 700 of FIGS. 19-21 includes a different anti-inversion strut mechanism 800.

In this embodiment, the anti-inversion strut mechanism 800 includes an anti-inversion strut 810 that has a first end 812 and an opposing second end 814. The first end 812 is operatively coupled to a floating notch 815 which is movingly disposed about the shaft 110. More specifically, the floating notch 815 is slidingly coupled to the shaft 110 and travels up and down the shaft 110 much like the runner 150. The floating notch 815 is located between the runner 150 and the top notch 119.

The floating notch 815 can be similar to the top notch 119 in terms of its construction and can be in the form of an annular shaped member that is attached to the shaft 110 and surrounds the shaft 110. The floating notch 815 is configured to receive anti-inversion struts 810 and thus serves an attachment point for such struts. The struts 810 are attached to the shaft 110 by fitting into the floating notch 815 and can then be held by a wire or other means. The floating notch 815 can be a thin, round nylon or plastic piece with teeth around the edges.

The first end 812 of the anti-inversion strut 810 is operatively coupled to the floating notch 815 and the second end 814 of the anti-inversion strut 810 is operatively coupled to the rib 200.

FIGS. 19-21 show the details of the strut 810. The anti-inversion strut 810 is formed of first and second parallel rods 820, 830. The first ends of the first and second parallel rods 820, 830 are coupled to a first joint 840 at the first end 812 and the second ends of the first and second parallel rods 820, 830 are coupled to a second joint 850 at the second end 814. The first joint 840 can be one of a male joint and a female joint and the second joint 850 can be one of a male joint and a female joint. For example, the first joint 840 can be in the form of a male joint (twin rod male joint) and the second joint 850 can be in the form of a female joint (twin rod female joint). The male joint (e.g., joint 840) is defined by a single protrusion (finger) 841, while the female joint (e.g., joint 850) is defined by a pair of spaced protrusions (fingers) 843 with a space 845 defined between the protrusions 843.

The first joint 840 is configured to be pivotally attached to the floating notch 815 and the second joint 850 is configured to be pivotally attached to the rib 200. With respect to the coupling between joint 840, the protrusion 841 of the first joint 840 is received in a complementary space (slot) formed in the floating notch 815.

The second joint 850 is operatively coupled to a floating joint, such as floating joint 500. As previously discussed, the floating joint 500 is slidingly coupled to the rib 200 and is configured to mate with the second joint 850. FIGS. 8A-D illustrate the floating joint 500. The floating joint 500 is defined by the main body 510 that includes the bore 512 that is formed therein and represents a through hole that passes from one end of the main body 510 to the other end thereof. The floating joint 500 also includes the joint connector 520 (FIG. 8A) in the form of a fin that extends radially outward from the main body 510. The connector 520 can be formed perpendicular to the main body 510. The connector 520 has an opening formed therein. The connector 520 thus represents a male joint.

The anti-inversion strut 810 is coupled to the rib 200 by inserting the connector 520 into the space 845 formed between the spaced fingers (protrusions) 843 of the second end joint 413. As in the other joint, a fastener or the like can be used to couple the connector 520 to the fingers 843.

The rib 200 is received within and passes through the bore 512 (FIG. 8A) and the size (diameter) of the bore 512 and the size (diameter) of the rib 200 are selected such that the floating joint 500 can freely move in a longitudinal direction along the length of the rib 200. This allows the floating joint 500 to be one which can freely travel up (toward the top notch 119) and down the rib 200 (toward the rib tip) when the umbrella opens and closes.

The strut 300 passes within the open space that is formed between the first and second parallel rods 820, 830 of the anti-inversion strut 810. This open space between the rods 820, 830 extends from the first joint 840 to the second joint 850 and accommodates the strut 300 in all positions of the umbrella from the fully closed position to the fully collapsed position.

As in the first embodiment, the rib 200 of umbrella 700 includes floating joint stop 530 that is fixedly attached to the rib 200. The floating joint stop 530 is disposed between the floating joint 500 and the second rib joint 230 and remains at a fixed location along the rib 200. The stop 530 includes a bore 532 that extends therethrough and receives the rib 200. The stop 530 is fixed to the rib 200 using traditional techniques so as to fix the stop 530 at a specific target location along the length of the rib 200. The stop 530 can be fixed by mechanical or overmolded which is the preferred method in this instance. The stop 530 is constructed such that it restricts the movement of the floating joint 500 in the direction toward the top notch 119. As in the first embodiment, the stop 530 prevents the rib 200 from inverting under pressure.

The anti-inversion mechanism in umbrella 700 is thus formed between and serves to connect the floating notch 815 to the floating joint 500 as opposed to the first embodiment in which the anti-inversion mechanism was located between a pivotable strut and the rib.

It will also be understood that the male/female type connections described herein can be reversed in that the part described herein as containing the male connector can instead contain the female connector and conversely, the part described herein as containing the female connector can instead contain the male connector. For example, the floating joint 500 is shown with a male connector 520; however, the floating joint 500 can instead be formed to have a pair of spaced fingers (flanges) that define a space therebetween (female connector). The distal end of the anti-inversion strut would thus be formed to have a male joint as opposed to the female joint that is shown. The coupling is the same in that the male joint is inserted into the space formed in the female joint. Similarly, the nature of the other joints, such as the connection between the strut and the fixed joint (e.g., joint 230) can be reversed.

The runner locking feature of the present invention also provides a number of advantages over conventional designs as well. In particular, the lock insert provides a connecting featureell between shaft segments that allows a method to lock the runner in place by not adding an additional locking feature which would increase the diameter of the runner which is not desired.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. An umbrella comprising:

an elongated shaft having a first end and an opposite second end;

a runner slidably disposed about the elongated shaft and movable along a length of the shaft; and a plurality of ribs that are attached to the runner by a plurality of main struts that move between open and closed positions in which in the open position, the ribs are in an open, extended position and in the closed position, the ribs are in a closed, collapsed position;

an anti-inversion mechanism comprising a plurality of anti-inversion struts, wherein each anti-inversion strut is pivotally coupled to the one main strut and is pivotally connected to a floating joint member that is freely movable along a length of the rib, the anti-inversion mechanism also including a stop that is fixedly attached to the rib at a fixed location and restricts the degree of travel of the floating joint member along the rib and is positioned to prevent the rib from inverting in response to an applied force by directly contacting the floating joint member, wherein the stop comprises a tubular structure that surrounds the rib and is separate and spaced from the floating joint member and from a tubular shaped rib joint fixedly attached along the rib to which the main strut is attached; wherein the main strut is formed as a single piece and a distal end of the main strut includes: (1) a distal end joint that has a female portion, formed of spaced apart parallel fingers, that mates with a protrusion of the tubular shaped rib joint that is fixedly attached along the rib and (2) a male type joint connector that mates with a female type end joint that is disposed at a first end of the anti-inversion strut;

wherein each rib includes a distal tip that is defined by a hollow body which has a bore formed therein, the bore containing both a distal end of the rib and a spring that is disposed within the bore between the distal end of the rib and a closed end of the bore.

2. The umbrella of claim 1, wherein the elongated shaft is formed of a plurality of shaft sections coupled to one another by a plurality of shaft lock members.

3. The umbrella of claim 2, wherein each shaft lock member has a first ridge and a second ridge spaced from the first ridge with a first space formed therebetween, the first and second ridges serving as stops for the shaft sections when assembled, wherein the first and second ridges extending radially outward relative to adjacent portions of the shaft lock member.

4. The umbrella of claim 3, wherein the runner includes a resilient lock member that engages the first space of one respective shaft lock member when the runner is in a locked position along the shaft.

5. The umbrella of claim 1, wherein a proximal end of each rib is pivotally attached to a top notch that is disposed along the shaft.

6. The umbrella of claim 1, wherein each main strut is pivotally attached to the runner at a proximal end and is pivotally attached to the rib at a distal end of the main strut and at a fixed first rib joint location defined along the rib, wherein the fixed location of the stop is located between the fixed first rib joint location and the floating joint.

7. The umbrella of claim 1, wherein the floating joint comprises a body that has a bore formed therein which receives the rib and a joint connector that is pivotally attached to the anti-inversion strut.

8. The umbrella of claim 1, wherein the anti-inversion strut also has a female type end joint at an opposing second end thereof, and the floating joint member includes a male type joint connector that mates with the female type end joint at the second end of the anti-inversion strut.

9. The umbrella of claim 1, wherein the distal tip has a delta-wing shape defined by a pair of beveled leading edges associated with two wings thereof.

10. The umbrella of claim 1, wherein the main strut is pivotally connected to the rib with a strut to rib joint that acts as a double joint in that the strut to rib joint joins the main strut to the rib and also joins the main strut to the anti-inversion strut.

11. The umbrella of claim 1, wherein the floating joint member comprises a main body with a bore through which the rib passes and a male joint that mates with a female end joint formed as part of the anti-inversion strut.

12. The umbrella of claim 1, wherein the spring is fully surrounded and contained within the bore of the distal tip.

13. The umbrella of claim 1, wherein the rib and spring are coaxially arranged.

14. The umbrella of claim 1, wherein the spring applies an axial force to the distal tip in a direction away from the distal end of the rib.

15. The umbrella of claim 1, wherein the distal rib tip is defined by a center body portion in which the blind hole is formed and an angled wing portion that extends distal to the center body portion and extends laterally from both sides of the center body portion.

16. The umbrella of claim 1, wherein the spring is sized such that the distal end of the rib is restricted to a location proximal to a proximal end of the spring.

17. An umbrella comprising:

an elongated shaft with a handle at one end;

a plurality of rib assemblies that support a canopy, each rib assembly including a rib that is attached to the shaft, the rib assemblies moving between open and closed positions in which in the open position, the ribs are in an open, extended position and in the closed position, the ribs are in a closed, collapsed position;

an anti-inversion mechanism comprising a plurality of anti-inversion struts, wherein each anti-inversion strut is attached to a first member that is coupled to the shaft and to one respective rib by a rib joint fixedly disposed at a first location along the rib such that the anti-inversion struts can move between open and closed positions, each anti-inversion strut being connected to a floating joint member that is freely movable along a length of one respective rib, the anti-inversion mechanism also including a stop that is fixedly attached to the rib at a select second location along the rib and is configured to restrict the degree of travel of the floating joint member along the rib so as to prevent the respective rib from inverting in response to an applied force, wherein the second location is spaced from the first location and the stop is separate from the rib joint to which the first member is coupled; and a runner slidably disposed about the elongated shaft and movable along a length of the shaft, wherein each rib is attached to the runner by a main strut which comprises the first member to which the anti-inversion strut is pivotally connected and wherein the runner includes a resilient lock member that engages a first space of one respective shaft lock member when the runner is in a locked position along the shaft;

a hollow distal rib tip that has an axial blind hole formed therein, wherein a spring is disposed within the blind hole and is in contact with a distal end of the rib such that the distal end of the rib and the spring are fully enclosed within the distal tip.

18. The umbrella of claim 17, wherein the main strut has a strut joint at a distal end thereof, the strut joint having a first connector that is pivotally connected to a complementary second connector associated with the rib and a third connector that is pivotally connected to a complementary fourth connector associated with the anti-inversion strut, whereby the anti-inversion strut is pivotally attached to the main strut.

* * * * *